United States Patent [19]

Ecob et al.

[11] 4,253,316

[45] Mar. 3, 1981

[54] SHOGGING MECHANISMS

[75] Inventors: Osmond H. Ecob, Blaby; Bertram Johnson, Braunstone, both of England

[73] Assignee: Wildt Mellor Bromley Limited, Leicester, England

[21] Appl. No.: 962,808

[22] Filed: Nov. 21, 1978

[30] Foreign Application Priority Data

Dec. 3, 1977 [GB] United Kingdom ..... 50438/77

[51] Int. Cl.[3] ..... D04B 9/10; D04B 9/06; D04B 15/12

[52] U.S. Cl. ..... 66/14; 66/26

[58] Field of Search ..... 66/14, 26, 95

[56] References Cited

U.S. PATENT DOCUMENTS

| | | | |
|---|---|---|---|
| 1,506,427 | 8/1924 | Howie | 66/95 X |
| 2,241,134 | 5/1941 | Hurd | 66/14 |
| 2,396,767 | 3/1946 | Wildt et al. | 66/14 X |
| 2,705,410 | 4/1955 | Sirmay et al. | 66/26 X |
| 2,835,119 | 5/1958 | Wiesinger et al. | 66/26 |
| 4,069,689 | 1/1978 | Takigawa | 66/14 |

FOREIGN PATENT DOCUMENTS

| | | | |
|---|---|---|---|
| 488368 | 12/1937 | United Kingdom | 66/14 |
| 1008588 | 10/1965 | United Kingdom | 66/14 |
| 1470704 | 4/1977 | United Kingdom | 66/14 |

*Primary Examiner*—Wm. Carter Reynolds

[57] ABSTRACT

A shogging mechanism for use for example in knitting cable pattern on circular knitting machines incorporates a cam on a mounting fixed with respect to one needle bed of the circular knitting machine. Movement of the cam on its mounting causes another needle bed of the circular knitting machine to be relatively displaced to an extent determined by the cam profile. The shogging mechanism cam is preferably rotatable by means of a further cam having a fixed relationship to the cam system of the knitting machine.

8 Claims, 6 Drawing Figures

SHOGGING MECHANISMS

DESCRIPTION

1. Field of Invention

This invention relates to shogging mechanisms particularly well suited for use on circular knitting machines of the type having pairs of relatively displaceable needle beds. Such shogging mechanisms may be used to increase patterning facility and to produce, for example, cable stitch effects. The invention is particularly adapted for use in circular knitting machines employing revolving cam systems for operating needles in a dial and cylinder or in a pair of superimposed cylinders.

2. Background of Invention

The British Pat. Nos. 488,368 and 1,008,588 show shogging mechanisms for knitting machines having revolving top and bottom cylinders and stationary cam systems. The shogging mechanism superimposes the shogging movement upon the cylinder rotation and involves a modified drive interconnection between the top and bottom cylinder compared with the backshaft which normally ensures conjoint top and bottom cylinder rotation. The play in the drive train and the shogging mechanism are added and hinder accurate relative positioning of the top and bottom cylinders. U.S. Pat. No. 4,069,689 describes a shogging mechanism for knitting machines having revolving cam systems for top and bottom cylinders. The cam systems are revolved conjointly at all times, but by a separate drive arrangement the top cylinder can be shogged with respect to the bottom cylinder which is stationary at all times. Aforementioned U.S. Pat. No. 4,069,689 employs separate racking pawls for causing counter clockwise and clockwise shogging of the upper cylinder respectively. The pawls are operated by levers engaging cam lobes revolving conjointly with the cam systems. The cams operate the levers without interruption but the pawls can be bluffed to prevent the to and fro lever and pawl movement from having effect. Plungers are used to hold the top cylinder in position when the pawls are bluffed.

Rack and plunger mechanisms are subject to wear which will lead to inaccurate shogging of the top cylinder. Particularly with fine gauge circular knitting machines, this wear may lead to misalignment of the needle tricks. If different extends of rack are desired, different lobes, pawls and rack and plunger segments may have to be provided. The number of components can be high as separate devices shog the top cylinder in each direction or hold it still. The rack mechanism may not be safe in use as it is difficult to interpose a fail-safe mechanism between the lobe on the one hand and the toothed rack segment on the other hand.

It is the object of the invention to provide an accurate, versatile shogging mechanism.

It is also a subsidiary object of this invention to provide a shogging mechanism not easily affected by wear, requiring few components and applicable to revolving cam system knitting machines as well as rotary cylinder knitting machines without involving modification of the back shaft.

SUMMARY OF THE INVENTION

The invention provides a shogging mechanism for a circular knitting machine with a pair of needle beds having tricks for locating needles, the shogging mechanism being mounted to determine the relative angular position of the needle beds and having means to shog the needle beds relatively through a predetermined angle. Apparatus in accordance with a preferred embodiment of the present invention includes a shogging cam with a suitable profile bodily retained on a mounting fixed with respect to one of the needle beds and further includes a member, fixed with respect to the other one of the needle beds, operable by the cam so that on moving the cam on the mounting the needle beds are shogged relatively to an extent determined by the cam profile. Accurate relative displacement can be obtained, and the shogging motion can be gradual and not abrupt thereby improving reliability. The invention is particularly useful for superimposed double cylinder machines, especially those with a revolving cam system, to give cable-stitch effects on fabrics by successive needle transfers and shogs. The shogging mechanism may be situated on a stationary top bed plate.

Preferably the cam is rotatable on an axis fixed with respect to the mounting and suitably then the profile is arranged to give different relative needle bed positions by rotation of the cam in one direction. This enables simple drive arrangements to be employed and gives a sturdy yet versatile construction.

The shogging cam axis defining member, fixed with respect to the other one of the needle beds, may be a pin and is operable by the cam in an indirect manner, preferably by using a lever pivoted by the cam on the mounting, which lever locates the pin. Conveniently the lever locates the pin using adjustable abutment screws. Preferably the lever has a pair of cam followers for engaging spaced cam sections so that the lever is pivoted positively by the cam profile in both senses. In this way the cam can be used to impart movement positively in both directions of movement of the shogged needle bed (clockwise and anti-clockwise) and also to hold the different needle beds in a particular relative position. No separate devices for moving in each direction for holding the needle beds are then are necessary. The cam may be moved through a linkage actuated by cam lobes fixed with respect to the cam system. Preferably the linkage includes a cam follower for following the cam lobes and a pair of arcs of gear teeth; i.e., quandrants; on respectively pivotable levers.

The reciprocating movement of the linkage imparted by cam lobes and/or springs can be converted into unidirection rotation of the shogging cam by a one-way mechanism. This mechanism is preferably in the form of a ratchet incorporating a ratchet wheel and a pawl mounted for conjoint movement with the linkage or shogging cam as the case may be. Play or wear in the ratchet mechanism does not appreciably influence shogging accuracy because the cam profile is smooth and small changes in the cam position do not materially affect the cam follower displacement. The cam can thus be arranged to provide in a single rotation thereof the various needle bed positions required in succession for cabling, and then return to its starting position, facilitating control for frequently repeated cabling. Different extends of shog can be provided by merely replacing the shogging cam. Advantageously the shogging mechanism is latchable in a neutral position, used for example for normal knitting in between cabling operations. The shogging mechanism may be brought to the neutral position by the cam lobes. Wear may be reduced in this way because idle operation of the shogging mechanism when knitting normally is avoided.

Preferably the latching mechanism has a fail-safe device to prevent transmission of the reciprocating motion by the linkage when no satisfactory latching has taken place.

The shogging mechanism thus is able to translate an angular movement imparted by a linkage into a very accurate shogging movement governed by the radii of the cam profile. The accuracy of the cam profile is not greatly affected by wear. Wear in the linkage connections do not result in inaccuracies in the shogging movement. The construction can be made sturdy and compact by using a single axis for many of the turntable components.

DESCRIPTION OF EXAMPLE OF THE INVENTION

Figure 1:
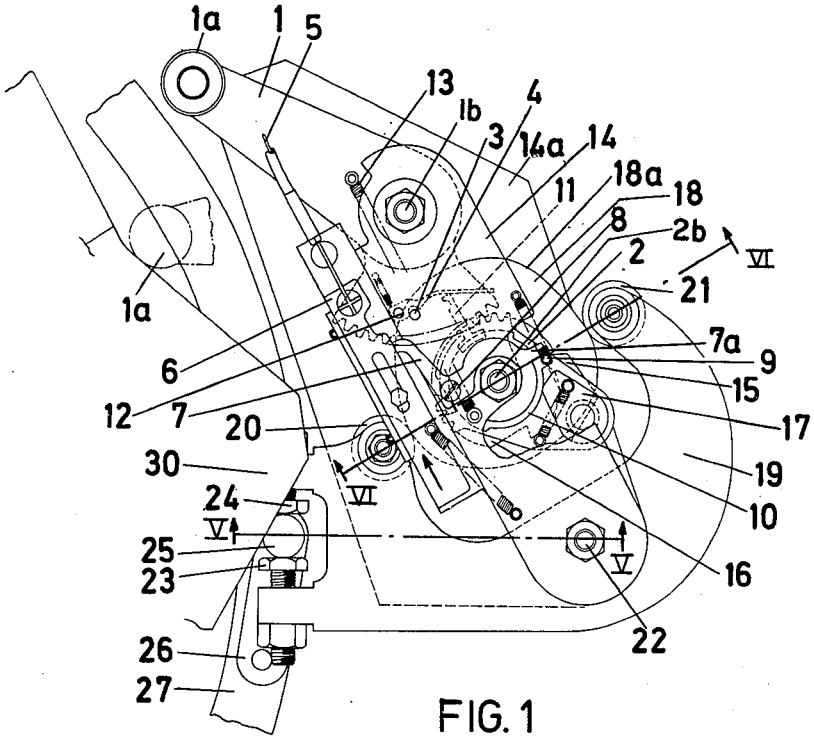
FIG. 1 is a plan view of a shogging mechanism, in a latch releasing position, according to a preferred embodiment of the invention.
Figure 5:
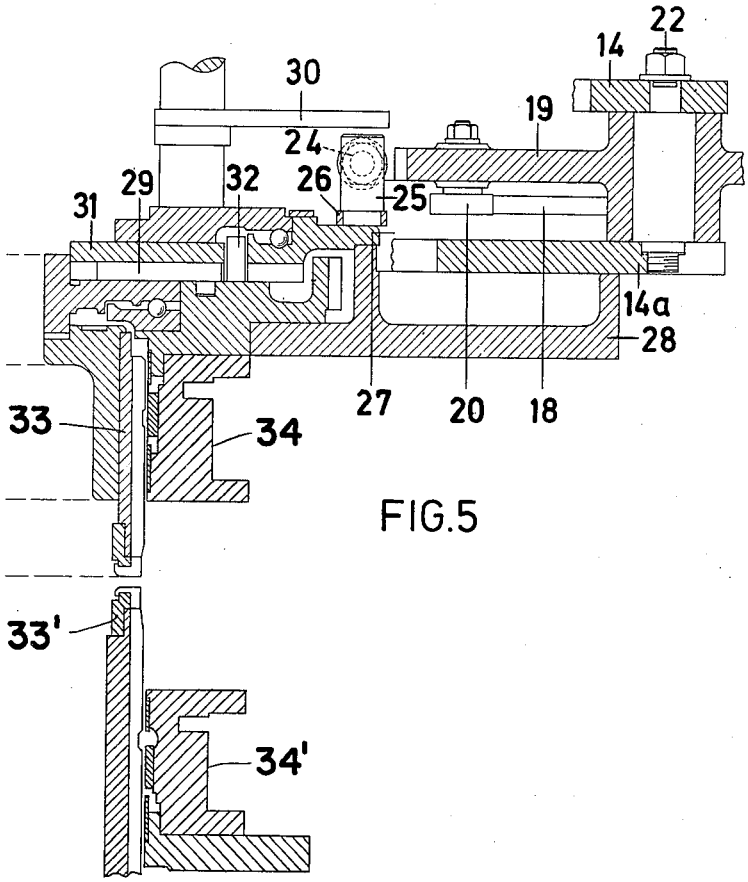
FIG. 5 is a partial vertical sectional view through an upper needle cylinder of a circular knitting machine having the mechanism of FIG. 1, FIG. 5 being taken along line V—V of FIG. 1 and also schematically depicting the bottom needle cylinder and the knitting machine cam system.

With reference to the Figures, a shogging mechanism (FIG. 1) has a first lever 1 having an arc of gear teeth meshing with an arc of teeth of a second lever 2. Both levers 1 and 2 pivot on their respective shafts 1*b* and 2*b* which are mounted between a top plate 14 (see also FIG. 6) and a bottom plate 14*a*, supported on a stationary top bed plate 28 (see FIG. 5) of the knitting machine which mounts the top cam system and top needle cylinder 33. Mounted in the lever 1 is a pin 3. The lever 1 is held in the position shown in FIG. 1 by means of a latching mechanism having a spring loaded latching member 4, having a semi-circular recess 40 which may be seen in FIG. 2, which retains the pin 3. Member 4 is pivoted on the stationary top plate 14. The quadrant 1 has previously been moved into the position shown in FIG. 1 by means of cam lobes 30 (only one of which is shown in FIGS. 1 and 3) which revolve together with the conventional top cam system which operates the needles of the machine. The knitting machine has in this case six yarn feeding stations and six cam lobes 30 which all revolve in synchronism and serve as actuating means for the shogging mechanism. The knitting machine has a pair of superimposed, normally stationary cylinders which may be arranged conventionally. The shogging mechanism is thus mounted on the stationary top bed plate 28 (see FIG. 5). Shogging movement of the top needle cylinder 33 is effected through a post 25 mounted in a plate 26 which in turn is secured to an outer dog ring 27. Connection between the outer ring 27 and an inner co-operating dog ring 31 (FIG. 5) is conventionally arranged through the medium of a plurality of slidable dogs 29, (only one shown in FIG. 5). The dogs 29 are withdrawn temporarily out of their slots in the outer dog ring 27 to permit the revolving yarn guides tubes and the yarn to pass between the outer and inner dog rings 27 and 31 whilst these are kept in the same relative position by the other dogs which are not withdrawn. In FIG. 5 the dog 29 is shown in its retracted position.

The inner dog ring 31 is bolted to the top needle cylinder 33 which would remain stationary during normal knitting. However, in cable stitch machines the top rings 27 and 31 are shogged together with the top needle bed with respect to the lower needle bed and the top bed plate 28. The movable driving dogs for connecting the inner and outer dog rings are a usual feature of this type of machine. The information just given illustrates the shogging connection from the post 25 through to the upper cylinder 33. The bottom needle cylinder 33' is fixed with respect to the top bed plate 28 so that by suitable operation of the shogging mechanism the upper cylinder can be made to move clockwise and counter clockwise with respect to the bottom cylinder. The mounting for the cam lobes 30 and a mounting for the conventional needle operating top cam system are revolved jointly independently of the top needle cylinder 33 by a conventional drive arrangement (not shown). The conventional knitting machine top cam system and bottom cam system are respectively depicted in FIG. 5 at 34 and 34'.

To commence shogging a cable 5 pulls a spring loaded slide 6 in the direction indicated by the arrow in FIG. 1. The pulling of the cable 5 is timed by a control mechanism so that it occurs as the roller 1*a* travels over the trailing part of a radially outward peak of an appropriate cam lobe 30. The shogging mechanism is now being primed for action as movement of the slide 6 causes a lever 7 to pivot about a stud 8 in a clockwise direction. The lever 7 has a portion 7*a* which, when moved in this clockwise direction, contacts a spring loaded pin 9 anchored to the ring-shaped member 10. A latch release member 11, attached to a ring-shaped member 10 which can be seen in FIG. 1, cams the spring loaded latching member 4 about its pivot 12 to thereby disengage the pin 3 and allow the lever 1 to move counter clockwise into the chaindot position by means of a spring 13 secured to the stationary top plate 14 as the cam follower roller 1*a* travels down the decline of the cam lobe 30. As soon as the roller 1*a* has passed radially inward of the cylinders sufficiently for the pin 3 to clear the recess in the latching member, the slide 6 may be returned to its original position. A one-way turning mechanism comprising racking pawl 15 is attached to lever 2 and is provided with a rack or ratchet wheel 16. The pawl is maintained in engagement with the ratchet wheel 16 by means of a spring connected to a bluffing cam 17 pivotable conjointly with the racking pawl 15 on the lever 2. The bluffing cam 17 is urged to contact the periphery of the ring member 10. The ring has a large diameter portion which, if it engaged the cam 17, would pivot cam 17 and the pawl to bluff the pawl 15. However the pin 3 engages the latch release member 11 on continued pivotal movement of the levers 1, 2 and causes the large diameter portion of ring-member 10 to remain clear of the cam 17. The priming movement imparted by the spring 13 and the decline of the cam lobe 30 relative to the lever 1, causes the pawl 15 to slip back one tooth on the ratchet wheel 16 so as to be ready for the subsequent operative movement; the foregoing resulting from the fact that actuation of lever 2, and thus of pawl 15 is derived from the motion of lever 1 transmitted via the cooperating gear teeth on levers 1 and 2. A shogging cam 18 is attached to the rachet wheel 16. As may be seen from FIG. 6, the axis of rotation of cam 18 is common with the axis of rotation of ratchet wheel 16. As may be seen from FIG. 6, the axis of rotation of cam 18 is common with the axis of rotation of ratchet wheel 16. As may also be seen from FIG. 6, lever 2 pivots about the same axis as cam 18 and this axis is located intermediate the pivot axes of levers 1 and 19. The cam may be a split cam to facilitate cam exchange. The cam 18 is rotated by the ratchet wheel in an counter clockwise direction only through 90° during each rack imparted to the ratchet wheel 16 during its operative movement. The cam 18 can occupy four different sectors to provide successively a shog in one sense from a "normal" position with the top and bottom cylinders in alignment; a shog in the other sense back to the normal position; a shog from the normal position in the other sense and a shog back to the normal position.

The shogging cam 18 has a profile 18*a* designed to provide control of a shogging lever 19 having a pair of cam following rollers 20, 21 which are in permanent contact with spaced zones of the profile of the cam 18. As a result of the priming movement of the roller 1*a* will commence to rise up the incline of the lobe 30 with the pawl 15 ready to transmit movement through the rachet wheel 16 to the cam 18 and cause the lever 19 to perform an operative movement.

During rotation of the shogging cam 18, a zone of the profile with a large radius will contact the roller 20 thus pivoting the lever 19 about a pivot 22 (see FIG. 3). A pair of adjustable stops 23 and 24 attached to the lever 19 will therefore move the post 25 in a clockwise direction. This post 25 is mounted in an adjustable plate 26 which in turn is secured to a ring 27 attached to the top needle cylinder. Therefore, on movement of this post 25 the upper cylinder is also moved three needle tricks to the left of normal alignment. The pin 3 is relatched, as the roller 1*a* reaches the peak of the cam lobe 30, holding the quadrant once more in its radially outward position with respect to the needle cylinders. By a subsequent priming and operative movement the cam 18 is racked through another 90° and the top needle cylinder is returned to normal alignment. yet a further rack of 90° of the cam 18 will cause the high profile of the cam 18 to contact the roller 21, which via the lever 19 will cause racking of the top needle cylinder three needle tricks to the right of normal alignment.

The quadrant 1 is latched by the member 4 at the end of each shot and then released, as previously described, prior to the commencement of the next shog.

Figure 2:
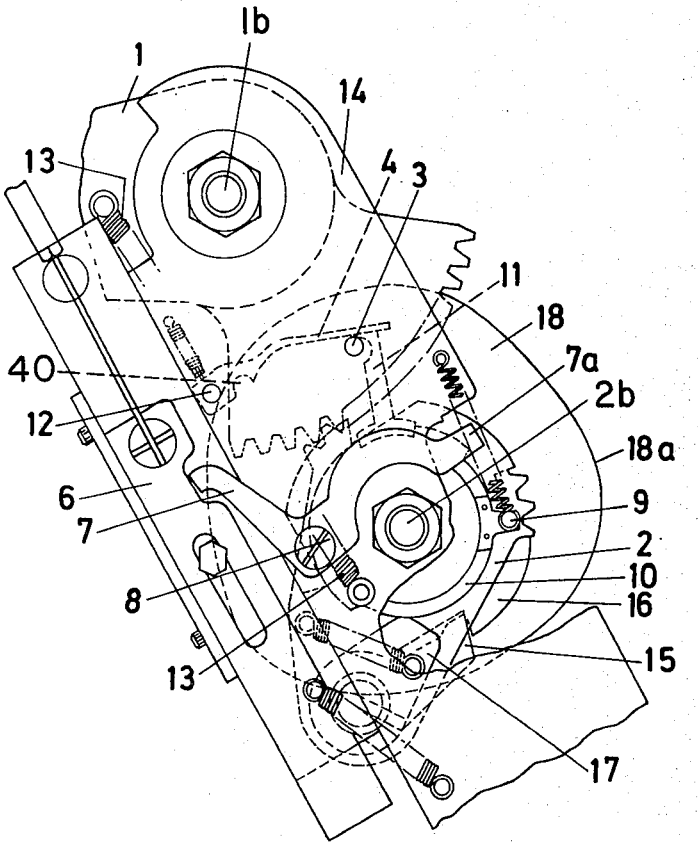
FIG. 2 is a plan view of the mechanism of FIG. 1 at the commencement of a shogging movement.
Figure 3:
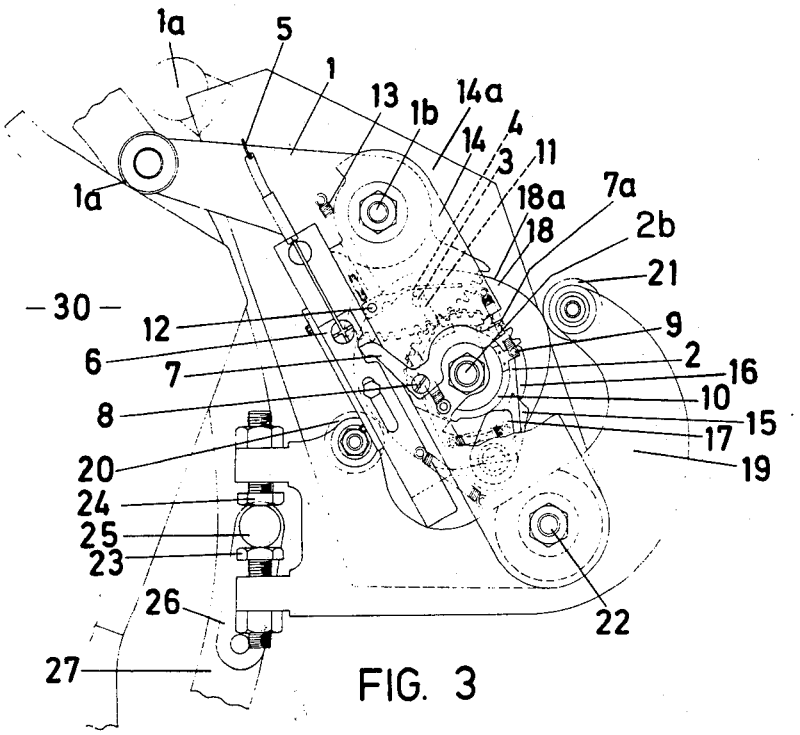
FIG. 3 is a plan view of the mechanism of FIG. 1 during a shogging movement.

With reference particularly to FIG. 2 the lever 1 is in a position whereby the roller 1*a*mounted at the end of the lever arm, is at the commencement of the cam incline (shown in chaindot in FIG. 1). The lever 2 has turned clockwise to allow the pawl 15 to engage the ratchet wheel 16 at the start of the operative movement.

With reference to FIG. 3 one of the cam lobes 30 revolving in the direction of the arrow turns the lever 1 in a clockwise direction. The lever 2 is thereby rotated in a counter clockwise direction to bring, for example, the high profile of the shogging cam 18 into a position which causes a movement of the top needle cylinder, equivalent to three needle tricks to the left of normal alignment, as previously described in more detail.

Figure 4:
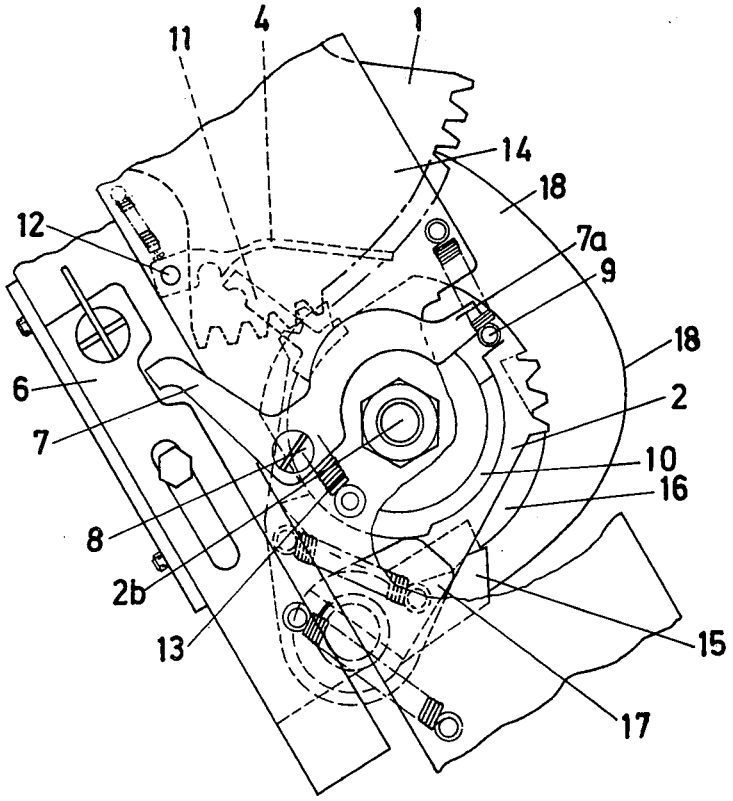
FIG. 4 is a plan view of the mechanism of FIG. 1 showing a bluffing facility provided by the mechanism.

With reference to FIG. 4, the pin 3 normally fastened in the lever 1 is shown broken off. The lever 1 could then not be retained by the latch member 4. Although of levers 1 and 2 both would swing to the positions shown in FIG. 4, after a priming movement, the member 11 (due to the absence of the pin) will not move the ring member 10 through a clockwise movement. The bluffing cam 17, fixed in relation to the pawl 15, will therefore ride onto the high, large radius portion of the ring member 10, thus keeping the racking pawl 15 lifted and out of engagement with the rachet wheel 16. No operative movement can thus take place to turn the cam 18 and no shogging movement of the top needle cylinder can occur.

FIG. 5 particularly shows the position of the cam ring provided with the cam lobes 30, each lobe acting on the quadrant roller 1*a*. This figure also shows the connection from the lever 19 to provide movement to the upper needle cylinder.

Figure 6:
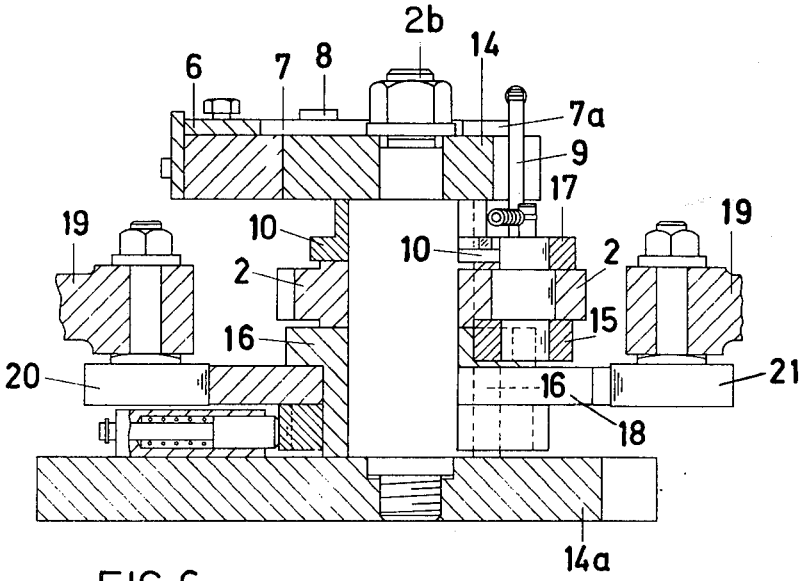
FIG. 6 is a part vertical sectional view through the shogging mechanism taken along line VI—VI of FIG. 1.

FIG. 6 illustrates a cross-sectional view of the racking mechanism assembly which shows the bluffing cam, lever, rachet wheel, racking pawl and shogging cam. An index wheel is provided, which together with a spring loaded plunger, temporarily retains the shogging cam 18 at each of the locations separated by 90°.

EXAMPLE OF USE OF SHOGGING MECHANISM

Before commencing cable stitching, needles which participate in making the cable stitch panels are placed in the bottom cylinder. Those needles between the panels may be distributed in both cylinders. For a six needle panel six adjacent needles are required in the bottom cylinder. Using FIG. 1 of U.S. Pat. No. 4,069,689 as a guide, the needles a, b, c, d, e, f, are holding loops in the bottom cylinder, while the three needles on both sides of the said panel are holding loops in the top cylinder.

At commencement of cable stitching, the camboxes are rotated once to cause the yarn at each feed position to be cut and trapped. The stitch cams of the upper cylinder are automatically adjusted to a position where their draw is insufficient to cause a needle to shed its loop, Thus, any rib needle having a loop in its hook will not pull on the loop as it passes over the stitch cam.

At the commencement of the next revolution of the cam boxes (after cutting and trapping all varns) the top cylinder is shogged clockwise (to the left) a distance of three needles, see FIG. 1, diagram II. Needles a, b, c, are transferred up (diagram III) through their loops, but the loops are not shed as the needles pass the stitch cams, because of the small draw position to which the knitting cams are adjusted as aforesaid. The loops on the transferred needles lie across the closed latches at a "tucking on the latch" level.

The top cylinder is now shogged counterclockwise through the original (neutral) position and then three needle pitches to the right of neutral, see diagram IV. Needles d, e, f, are transferred up to position (shown in diagram V). To conclude the "cabling" operation the top cylinder is now shogged to the neutral position (see diagram IV) and the panel needles are transferred down to the bottom cylinder in the order d,e,f,a,b,c. Knitting can now continue for the required number of courses before a repeat of the cable stitch sequence is made.

Whilst the various operations are taking place, the cam system continues to revolve and the successive lobes 30 actuate the shogging mechanism so that the whole operation can take place within one revolution of the cam system.

The shogging mechanism can be adapted for a knitting machine having a rotary upper and lower cylinder without modifying the backshaft usually present in these machines by for example causing an upper backshaft pinion to drive an annular member and mounting the shogging mechanism on the annular member for shogging a top cylinder located within the annular member. The shogging mechanism is then revolved and can be operated by cam lobes located in a fixed relationship to the stationary cam system of such machines.

The profile of the cam 18 may be varied to provide displacements other than over 3 needle pitches as required or for other gauges without requiring a change in any other part of the mechanism.

Also by commencing the cable stitch shogging action at a time when the cam 18 is positioned 180° from the position shown in FIG. 1, the cable panel will be produced with an opposite direction of twist.

The shogging movement is of an accurately predetermined extent and smooth in nature in that there is no abrupt start or end to the movement as might occur with racking induced displacement. Play between the gear quadrants on levers 1 and 2 does not materially contribute to play in the shogging movement.

I claim:

1. In a knitting machine having a pair of relatively displaceable needle beds and a cam system for operating the needles in the said beds, an improved shogging mechanism including:

first cam means;

means mounting said first cam means, said mounting means being fixed in position relative to the knitting machine cam system;

lever mounting means, the position of said lever mounting means relaive to one of the needle beds being fixed;

first lever means pivotally mounted on said lever mounting means, said first lever means including a first lever having a cam follower at one end thereof, said cam follower engaging said first cam means, said first lever means further comprising resilient means urging said cam follower onto said first cam means and latching means for urging said cam follower to an inoperative position;

second lever means pivotally mounted on said lever mounting means, said second lever means including a second lever;

means for interconnecting the first and second levers respectively of said first and second lever means;

a one-way turning mechanism, said one-way turning mechanism having an input member coupled to said second lever means for movement conjointly with said second lever, said one-way turning mechanism further having an output member;

second cam means rotatably mounted on said lever mounting means, said second cam means being coupled to said one-way turning mechanism output member for movement conjointly therewith;

third lever means pivotally mounted on said lever mounting, said third lever means including a third lever having cam follower means mounted thereon at a first end thereof, said third lever means cam follower means contacting said second cam means and reciprocating said third lever to an extent determined by the profile of said second cam means; and means coupling the second end of said third lever means lever to the other of the needle beds, said coupling means being fixed in position relative to the other said needle bed whereby the other needle bed will move conjointly with the said third lever.

2. A shogging mechanism as claimed in claim 1 wherein the cam follower means on said third lever means third lever comprises a pair of rollers for engaging the second cam means at diametrically opposite positions for moving the member positively in either direction.

3. A shogging mechanism as claimed in claim 1 wherein said means for interconnecting the first and second levers of said first and second lever means comprises meshing gear sectors connected to turn the second cam means by substantially 90° for each movement of the first lever resulting from engagement with the first cam means.

4. A shogging mechanism as claimed in claim 3 wherein the one-way turning mechanism includes a pawl and ratchet mechanism and wherein said one-way turning mechanism output member comprises part of said ratchet mechanism and is pivotable about the axis of rotation of said second cam means.

5. A shogging mechanism as claimed in claim 1 wherein said first lever means latching means includes a latching hook and a latching pin, said latching means further comprising movable latch release means biased to a position engaging the latching pin, said latch release means disconnecting drive transmission through said one-way turning mechanism when said latching pin is not engaged thereby.

6. A shogging mechanism as claimed in claim 1 in which a pivot axis of the second lever means second lever is located between the pivot axes of the first and third levers and coincides with that of the second cam means and the input and output members of the one-way turning mechanism.

7. In a knitting machine having a pair of relatively displaceable needle beds and a cam system for operating the needles in the beds, an improved shogging mechanism comprising:

a rotatable shogging cam;

means for mounting said shogging cam for rotation about an axis fixed with respect to one of the knitting machine needle beds;

actuating means for said shogging cam, said actuating means including a first lever having a cam follower at one end thereof, said cam follower being positioned in operative relationship to a cam of the knitting machine needle operating cam system, said actuating means first lever further having a first gear sector at the other end thereof, said first lever pivoting about an axis positioned in proximity to said first gear sector, said actuating means additionally including a second actuating lever having mounted thereon a second gear sector which engages said first gear sector, said actuating means also including means coupling said second actuating lever to said shogging cam to turn said shogging cam by approximately 90° for each movement of said first lever;

one-way turning means interposed between said actuating means and said shogging cam whereby said actuating means second lever may turn said shogging cam in one direction only; and means coupling said shogging cam to the other of the knitting machine needle beds whereby the other of said needle beds will be displaced to an extent determined by the shogging cam profile when the shogging cam is rotated.

8. In a knitting machine having a pair of relatively displaceable needle beds and a cam system for operating the needles in the beds, an improved shogging mechanism comprising:

a shogging cam;

means for mounting said shogging cam for rotation about an axis fixed with respect to one of the knitting machine needle beds;

actuating means for said shogging cam, said actuating means including a first lever having a cam follower at one end thereof, said cam follower being positioned in operative relationship to a cam of the knitting machine needle operating cam system, said actuating means first lever further having a first gear sector at the other end thereof, said first lever pivoting about an axis positioned in proximity to said first gear sector, said actuating means additionally including a second pivotal actuating lever having mounted thereon a second gear sector which engages said first gear sector;

means coupling said actuating means second actuating lever to said shogging cam to cause rotation of said shogging cam, said coupling means including a pawl and ratchet wheel whereby said shogging cam will turn in one direction only and in stepwise fashion in response to knitting machine cam system induced movements of said first lever; and means coupling said shogging cam to the other of the knitting machine needle beds whereby the other of said needle beds will be displaced to an extent determined by the shogging cam profile when the shogging cam is rotated.

* * * * *